United States Patent [19]

Ventavoli et al.

[11] Patent Number: 5,027,884

[45] Date of Patent: Jul. 2, 1991

[54] PROCESS AND DEVICE FOR PRODUCING THIN METAL PRODUCTS BY CONTINUOUS CASTING

[75] Inventors: Roger Ventavoli, Fameck; Daniel Neyret, Metz, both of France

[73] Assignee: Techmetal Promotion, Maizières-les-Metz, France

[21] Appl. No.: 503,864

[22] Filed: Apr. 3, 1990

[30] Foreign Application Priority Data

Apr. 6, 1989 [FR] France ..... 89 04862

[51] Int. Cl.[5] ..... B22D 27/02; B22D 11/16

[52] U.S. Cl. ..... 164/452; 164/154; 164/468; 164/504

[58] Field of Search ..... 164/468, 504, 452, 455, 164/154, 476, 417

[56] References Cited

FOREIGN PATENT DOCUMENTS 2352611 12/1977 France ..... 164/154

60-148651 8/1985 Japan ..... 164/476

61-132247 6/1986 Japan ..... 164/468

*Primary Examiner*—Kuang Y. Lin

*Attorney, Agent, or Firm*—Pollock, Vande Sande & Priddy

[57] ABSTRACT

A process and apparatus for producing thin metal products by continuous casting. The apparatus comprises an ingot mold (2) and squeezing rolls (6, 6') intended to cause, by reduction of the thickness of product, closing of the solidification pool. The separation force (F) exerted on the squeezing rolls by the product is measured and a variable magnetic field, matched to the separation force so that the latter does not exceed over a long period a predetermined upper limit value representing the force that the squeezing rolls can tolerate temporarily without damage, is applied to the core of the still molten product by inductors (8, 8') housed in, or upstream of, the squeezing rolls.

10 Claims, 1 Drawing Sheet

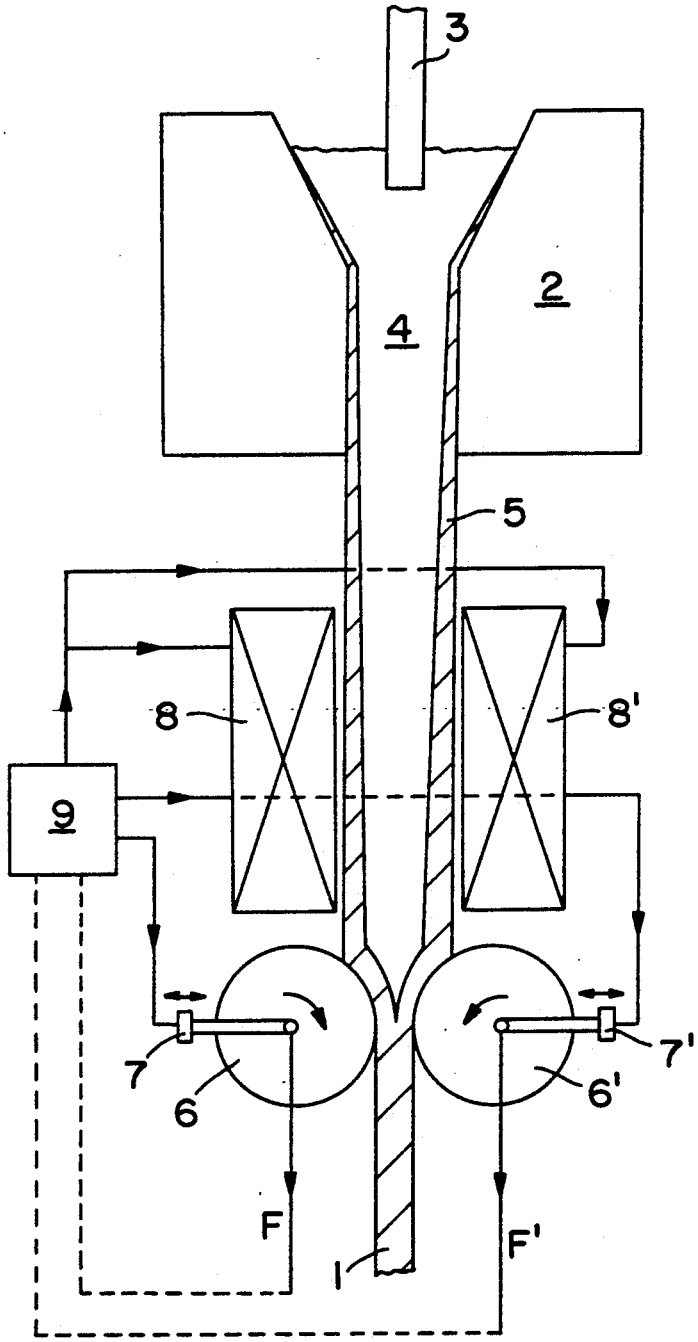
3
2
4
5
8
8'
9
7
7'
6
6'
F
F'
1

PROCESS AND DEVICE FOR PRODUCING THIN METAL PRODUCTS BY CONTINUOUS CASTING

FIELD OF THE INVENTION

The invention relates to the production of thin metal products directly by continuous casting. It relates more particularly to the production of thin steel slabs, i.e., flat products whose final thickness rarely exceeds 100–120 mm but is usually in the region of 20–50 mm.

BACKGROUND OF THE INVENTION

Installations for the continuous casting of steel slabs having these small thicknesses are distinguished from installations for the continuous casting of slabs of standard thickness (of the order of 150–200 mm), particularly by the presence, downstream of the ingot mold in the direction of withdrawal of the product, of at least one pair of rolls, called squeezing rolls. These have the function of bringing the product to its final thickness, without actual rolling, after it emerges from the ingot mold, by simply bringing the large faces of the cast product closer together. The ingot mold, whose design is derived from that of ingot molds for conventional continuous casting, does not, in fact, make it possible to directly produce the desired small thicknesses. The space between the squeezing rolls is fixed, in principle, throughout casting and is equal to the thickness desired for the product. They grip the product so as to bring about the advanced closing of the molten pool. On emerging from the rolls, the product is thus usually entirely solidified throughout its section. In any case, there is no longer any core in a completely molten state.

In order to achieve maximum thickness reduction, it is advantageous to locate the squeezing rolls directly at the exit from the ingot mold. However, this location is not without drawbacks. In particular, it risks giving rise to premature shrinking of the cast product from the cooled wall of the ingot mold in the final part of the latter, which may give result in a breakout. It is thus possible to design installations in which the squeezing rolls are sufficiently distant from the exit from the ingot mold, at a distance of the order of 1 m, for example.

One problem to be solved in the utilization of such a machine is the regulation of the depth of the molten pool (also called "metallurgical height"). As has been seen, the squeezing rolls are designed in order to shape a product whose core is still molten. If the molten pool is closed upstream of the squeezing rolls, these must thus act on a product which is entirely in the solid or mushy state. In order to bring the product to the desired thickness, they must undergo a severe separation force exerted by the product, which is, in fact, equivalent to an actual rolling on solid product. Such a force, if it is too great, or if it is repeated too frequently and over too long a period of time, can give rise to serious damage to the rolls themselves and their holding members. On the other hand, a machine capable of withstanding such great separation forces would scarcely be compatible in size with the rest of the casting installation due to the great rigidity of the frame which would be necessary. In any case, its cost would be far greater than that of a normal installation.

SUMMARY OF THE INVENTION

The invention relates to a method for the rapid regulation of the depth of the liquid pool which makes it possible to bring the force undergone by the squeezing rolls to its nominal value as soon as an abnormal increase in this force is detected.

To this end, the subject of the invention is a process for the continuous casting of thin metal products, particularly steel products, in an installation comprising an ingot mold which is followed, in the direction of withdrawal of the cast product, by squeezing rolls intended to cause, by a reduction of the thickness of the said product being cast, the closing of the solidification pool, wherein:

the separation force continuously exerted on the squeezing rolls by the product is measured;

and, in a zone located upstream of the squeezing rolls or between the latter, a variable magnetic field is applied to the still molten core of the product, while making the action of said magnetic field dependent on the value of the separation force measured so that the latter does not exceed, over a long period, an upper limit value given in advance and representing the force that the squeezing rolls can tolerate temporarily without damage.

This variable magnetic field may be mobile and thus exert a stirring action on the molten core of the cast product, which stirring, as is known, favors the removal of heat or, on the other hand, may be fixed and exert an inductive heating action on the cast product.

A further subject of the invention is a continuous casting device for implementing this process, comprising means for measuring the separation force exerted by the cast product on the squeezing rolls, an inductor at least generating a variable magnetic field in the cast product upstream of the squeezing rolls or between the latter, and means for making said magnetic field dependent on the value of the separation force exerted by the product on the squeezing rolls.

The inductor or inductors may be located between the ingot mold and the squeezing rolls, or housed in the squeezing rolls, as described, for example, in Luxemburg Patent No. 67 753, whose contents are incorporated by reference into the present description.

These inductors can impose stirring movements on the molten core of the cast product or exert a heating action on the cast product.

As will have been understood, it is by means of the stirring action exerted on the molten core in order to facilitate removal of excess heat or, on the other hand, by means of the heating action exerted on the product, that the depth of the molten pool is regulated.

Stirring of the molten core of the product being cast is, nowadays, in very wide use in the continuous casting of conventional-format steel products: blooms, billets and slabs approximately 200 mm thick. The customary aims thereof are the production of solidification structures favorable to the mechanical properties of the final product, such as a high proportion of solidified section in an equiaxial mode and a reduction in segregations. However, stirring also plays a part in the removal of heat from the metal: this is all the more rapid when the molten metal is moved more intensely.

Moreover, all things being equal, an increase in the stirring action on the molten core thus tends to accelerate solidification of the product and to cause the point of closure of the molten pool to ascend. Inversely, a reduction in the stirring action tends to delay solidification of the product and to cause the point of closure of the molten pool to descend.

In the continuous casting of large-section products, this effect of stirring on the cooling of the product has only relatively secondary importance inasmuch as cooling is mainly provided, below the ingot mold, by means of a cooling fluid sprayed on the surface of the product. On the other hand, it is not sought to regulate the point of closure of the molten pool, which is generally located several meters below the ingot mold, with great accuracy. On the contrary, in the casting of thin slabs, the smallest thickness of the molten core renders the latter highly sensitive to all phenomena which can accelerate its solidification and, particularly, to forced convection movements such as those induced by a mobile magnetic field. By permanently setting up such movements within the molten core and by modulating their intensity, a possibility is thus provided for regulating the depth of the solidification pool without altering the operating parameters of the machine. In the case of the continuous casting of thin slabs with squeezing rolls which are distant from the ingot mold, it has been seen that such regulation was highly important. This capability may be added to or replace other surface-acting means for cooling the product, such as the spraying of a cooling fluid. It has the advantage of acting directly on the molten core and obtaining a short reaction time.

The intensity of stirring is modulated as a function of the measurement of the force exerted by the product on the squeezing rolls whose separation is, in normal operation, maintained constant and equal to the thickness desired for the product. The squeezing rolls are designed to withstand a force whose value F, which is measured by means of sensors continuously or at short time intervals, corresponds to the closing of the molten pool. If F becomes greater than its normal value, it indicates that the squeezing rolls are undergoing stress on the part of a product whose core is already no longer in the molten state. Such a separation relative to the normal operation of the machine may be due to factors such as a voluntary or involuntary reduction in the casting speed, a drop in the temperature of the molten metal feeding the ingot mold, etc. The start and the end of casting, during which times the temperature of the molten metal and the speed of progress of the product can vary to a great extent, also constitute critical periods. In fact, it is then difficult to adjust the operating parameters of the machine so as to permanently locate the point of closure of the molten pool at the desirable level. The possibility of influencing the solidification speed of the metal by means of the intensity of stirring the molten core gives the operator a further means of action for controlling the operation of the machine.

DESCRIPTION OF THE PREFERRED EMBODIMENT

An example of implementation of the procedure will now be described. By means of mathematical modelling and tests on the machine, a determination is made, for given casting conditions (format of the product, casting speed, temperature of the molten metal feeding the ingot mold, etc.), of which operating parameters of the device for stirring the molten core make it possible, in principle, for the closing of the molten pool to occur at the most favorable level, i.e., at the level of the squeezing rolls. Moreover, two threshold values Of and F1 are fixed for F. Of is a value below which the force is considered abnormally low and reflects a risk that the molten pool will not be closed. F1 is a value beyond which it is considered that the force undergone by the rolls is too great and must not be permanently maintained. If this value F1 is reached, it signifies that the solidification pool is being closed prematurely. Consequently, the operator reduces the intensity of the electromagnetic stirring in stages so as to reduce the movements of the metal in order to slow down its solidification. After each incremental reduction, the force exerted on the rolls is measured. If it remains greater than F1, the intensity of stirring is further reduced. If it is between Of and F1, the new intensity of stirring is maintained until any return to normal of the casting conditions renders this stirring intensity insufficient and moves the point of closure of the molten pool below the squeezing rolls. Such a displacement must be reflected in a force which is less than Of, and it is then necessary to increase the stirring intensity in order to bring the force into the Fo–F1 range Moreover, it is possible to fix a threshold value F2, greater than F1, beyond which the force tending to separate the squeezing rolls must, under no conditions, be borne for more than a few moments. Exceeding of this threshold F2 must then give rise not only to a major and sudden reduction in the intensity of stirring, but also a separation of the rolls in stages. After each stage, the force borne by the rolls is measured. If it remains greater than F2, the space between the rolls is increased. When it becomes less than F2, the rolls are then brought closer together. Next, if the force again becomes greater than F2, the rolls are again separated. If, on the other hand, after the rolls have been brought closer together, the force remains less than F2, they are brought closer together still, and so on until the rolls have returned to their nominal separation with a force which is less than F2. From this moment, in order to bring the force to a value between Of and F1, further modification is restricted to the intensity of stirring.

In order to take into account the inertia of the action of the magnetic field, it is also possible to fix a warning value F3 which is less than F1, such that when, on increasing, the separation force reaches F3, the action of the magnetic field is modified. It is thus possible to anticipate crossing of the threshold F1 and to reduce the risks of damage to the machine. Symmetrically, it is possible to fix a warning value F4 which is greater than Of such that when, during reduction, the separation force reaches F4, the magnetic field is modified. This thus slightly further limits the risks of defects in the product, which defects would be due to closing of the molten pool with excessive delay.

The members which control the intensity of stirring and the separation of the squeezing rolls are controlled by the operator or the data-processing unit governing the operation of the casting machine and using data supplied by the necessary measurement instruments: measurements of the force on the rolls, the separation of the rolls, the electrical parameters of the electromagnetic stirrers, the casting speed, etc.

The sliding-field electromagnetic stirrers may be any of various types of known stirrers imposing on the metal translation movements which are vertical or perpendicular to the withdrawal direction, along the large faces of the product, or rotational movements. Advantageously, but not exclusively, they are of the so-called "stirring roll" type, described, for example, in applicant's patent FR 2187468. They are then included in rolls which also serve to support the product (without compressing it) between the lower part of the ingot mold and the squeezing rolls. Plane stirrers, disposed opposite the large faces of the product in this same zone of the machine, may also be used.

BRIEF DESCRIPTION OF THE DRAWINGS

The single drawing figure schematically shows an example of an installation for the continuous casting of thin slabs according to the invention, seen in section and in profile.

DESCRIPTION OF PREFERRED EMBODIMENT

As shown in the drawing, the cast product 1 emerges from the ingot mold 2, fed with molten metal by the nozzle 3, in the partially solidified state. Its core 4 is in the molten state and is surrounded by a peripheral layer 5 in the mushy or entirely solidified state, the thickness of which increases as the product progresses in the machine and solidifies. The installation comprises a pair of squeezing rolls 6, 6', in free rotation or driven in the direction indicated by the arrows, located at a predetermined distance from the ingot mold, remote from its immediate vicinity. These rolls reduce the thickness of the product to the desired value by bringing closer together the layers of metal which have begun to solidify on the large faces of the ingot mold so as to close the molten pool. They are equipped with means 7, 7' which make it possible to regulate their separation and to maintain this at a specific value. The installation also comprises electromagnetic means for stirring the molten core 4. Those may consist, as shown in the drawing, of a pair of plane multiphase stirrers 8, 8', disposed opposite the large faces of the product, between the base of the ingot mold and the squeezing rolls, and generating a sliding magnetic field. Sensors measure the rolling forces F and F' exerted by the product on the squeezing rolls 6 and 6', respectively, and transmit the results of these measurements to a data-processing unit 9. As a function of the data transmitted by the sensors, this unit controls the operating parameters of the stirrers which determine the intensity of the movements inside the molten core, on a continuous basis. This unit also controls the separation of the squeezing rolls if the rolling force exerted on one of them by the product exceeds the previously defined threshold F2.

In addition to or instead of the stirrers located between the base of the ingot mold and the squeezing rolls, it is also possible to use stirrers included in the ingot mold. However, as they have to act on a molten core of a relatively large volume and as they are located at some distance from the bottom of the molten pool, there is a risk that these stirrers in the ingot mold will be insufficient to ensure, by themselves, a sufficiently sudden variation in the solidification speed of the molten core.

A further alternative embodiment consists in housing the inductors in the actual squeezing rolls, which are made tubular for this purpose. They are then particularly well suited to an acceleration of solidification if the molten core is closed below the squeezing rolls. Moreover, it is possible for them to stir the molten metal only in the latter case, or to be active permanently, like the devices described above They may be employed alone or in combination with other devices for stirring the molten core.

Finally, it is possible to replace some or all of the mobile field inductors which stir the molten core by inductors with a variable but stationary field, the function of which is to permanently or intermittently supply a flow of heat to the molten core. This flow of heat may be modulated so as to maintain the closing of the molten pool above the squeezing rolls. It is increased when the molten pool is closed upstream of the squeezing rolls and reduced when the molten pool is closed below the squeezing rolls. It is particularly advantageous to install such a device inside the squeezing rolls since it can then act in the actual zone where its effect must be primarily felt.

We claim:

1. In a process for continuously casting a thin metal product, said process comprising the step of causing, in an installation comprising an ingot mold (2) followed, in the direction of withdrawal of a cast product, by squeezing rolls (6, 6'), the closing of its solidification pool by a reduction of a thickness of said product, the improvement comprising the steps of (a) measuring a separation force exerted on said squeezing rolls by said cast product; and (b) applying to a still molten core of said cast product a variable magnetic field having an action dependent on a measured value of said separation force, so that the latter does not exceed, over a period of predetermined duration, a predetermined upper limit value representing a maximum force that said squeezing rolls can tolerate temporarily without damage to said squeezing rolls.

2. The improvement claimed in claim 1, wherein said magnetic field is a stationary variable magnetic field, having an inductive heating effect on said product.

3. The improvement claimed in claim 1, wherein said magnetic field is a traveling variable magnetic field having a stirring effect on said molten core of said product.

4. The improvement claimed in any one of claims 1 to 3, including the steps of making an action of said magnetic field dependent on a value of a rolling force measured so that said rolling force is maintained between a predetermined upper limit value F1, representing a separation force not to be exceeded over a period of predetermined length in order to avoid damage to said squeezing rolls, and a predetermined lower limit value Of, representing a presence downstream of said squeezing rolls of a core of said product which is still molten.

5. The improvement claimed in claim 4, comprising the steps of increasing separation of said squeezing rolls by increments if said separation force exceeds a fixed value F2 greater than or equal to said upper limit value F1, so as to bring said separation force back to a value less than F1, and then returning said separation of said squeezing rolls, in stages, to its nominal value, by ensuring that said separation force is no greater than said fixed value F2.

6. The improvement claimed in claim 4, comprising the step of modifying the action of said magnetic field in order to take into account the inertia of said action of said magnetic field, when said separation force, upon increasing, reaches a fixed warning value F3 less than said upper limit value F1.

7. The improvement claimed in claim 4, comprising the step of modifying the action of said magnetic field in order to take into account the inertia of said action of the magnetic field, when said separation force, upon decreasing, reaches a fixed warning value F4 greater than said lower limit value Of.

8. Apparatus for continuously casting a thin metal product, of a type comprising an ingot mold (2) followed, in the direction of withdrawal of the cast product, by squeezing rolls causing, by reduction in a thickness of said product, closing of a solidification pool, said apparatus further comprising (a) means for measuring separation force exerted by said cast product on said squeezing rolls (6, 6');

(b) inductor means (8, 8') housed in a vicinity of said squeezing rolls and adapted to generate a variable magnetic field in a part of said cast product which is still molten; and (c) means (9) for matching said inductors to the separation force exerted by said product on said squeezing rolls in order to prevent said separation force from exceeding over a period of predetermined duration a predetermined upper limit value representing a force that said squeezing rolls can tolerate temporarily without damage to said squeezing rolls.

9. Apparatus claimed in claim 8, wherein said inductor means is a multiphase sliding-field inductor.

10. The device as claimed in claim 8, wherein said inductor means is a single-phase induction coil.

* * * * *